US006857274B2

(12) United States Patent
Sprouse et al.

(10) Patent No.: US 6,857,274 B2
(45) Date of Patent: Feb. 22, 2005

(54) FLUID INJECTOR AND INJECTION METHOD

(75) Inventors: Kenneth M. Sprouse, Northridge, CA (US); David R. Matthews, Simi Vally, CA (US); Robert J. Jensen, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 10/811,203

(22) Filed: Mar. 26, 2004

(65) Prior Publication Data

US 2004/0177619 A1 Sep. 16, 2004

Related U.S. Application Data

(62) Division of application No. 10/242,341, filed on Sep. 12, 2002, now Pat. No. 6,802,178.

(51) Int. Cl.[7] ..... F02C 3/20

(52) U.S. Cl. ..... 60/776; 60/39.463

(58) Field of Search ..... 60/39.463–39.465, 60/39.5, 742, 746, 772, 776–781

(56) References Cited

U.S. PATENT DOCUMENTS

| | | | |
|---|---|---|---|
| 2,636,778 | A | 4/1953 | Michelsen |
| 2,785,926 | A | 3/1957 | Lataste |
| 2,857,204 | A | 10/1958 | Gross |
| 2,930,532 | A | 3/1960 | Johnson |
| 3,056,559 | A | 10/1962 | Orr |
| 3,093,315 | A | 6/1963 | Tachiki et al. |
| 3,121,639 | A | 2/1964 | Bauer et al. |
| 3,430,863 | A | 3/1969 | Canavan et al. |
| 3,603,092 | A | 9/1971 | Paine et al. |
| 3,610,537 | A | 10/1971 | Nakagawa et al. |
| 3,729,285 | A | 4/1973 | Schwedersky |
| 3,779,212 | A | 12/1973 | Wagner |
| 3,837,788 | A | 9/1974 | Craig et al. |
| 3,850,569 | A | 11/1974 | Alquist |
| 3,923,011 | A | 12/1975 | Pfefferle |
| 3,928,961 | A | 12/1975 | Pfefferle |
| 4,021,186 | A | 5/1977 | Tenner |

(List continued on next page.)

FOREIGN PATENT DOCUMENTS

| | | |
|---|---|---|
| EP | 1 013 990 A2 | 6/2000 |
| WO | WO 00/43712 | 7/2000 |

OTHER PUBLICATIONS

O. Bolland and S. Saether, New Concepts for Natural Gas Fired Power Plants Which Simplify The Recovery Of Carbon Dioxide; Energy Convers. Mgmt, 1992, pp. 467–475, vol. 33, No. 5–8, Pergamon Press Ltd, Great Britain.

Olav Bolland and Philippe Mathieu, Comparison Of Two $CO_2$ Removal Options In Combined Cycle Power Plants, Energy Convers. Mgmt, 1998, pp. 1653–1663, vol. 39, No. 16–18, Elsevier Science Ltd, Great Britain.

*Primary Examiner*—Louis J. Casaregola
(74) *Attorney, Agent, or Firm*—Alston & Bird LLP

(57) ABSTRACT

There are provided an injector and an associated method for injecting and mixing gases, comprising a carbonaceous fuel and oxygen, in a combustion chamber of a combustion device. The injector has jets, which can be used to separately inject different combustion fuels. The injector is compatible with combustion devices that inject only gases, for example, a reheater that provides initial combustion in a power generation cycle or a reheater that recombusts a discharged gas from a gas generator and turbine. Further, the injector defines an annular space through which a recycle gas can be injected into the combustion chamber to lower the combustion temperature.

11 Claims, 5 Drawing Sheets

U.S. PATENT DOCUMENTS 4,021,188 A 5/1977 Yamagishi et al.
4,054,407 A 10/1977 Carrubba et al.
4,102,125 A 7/1978 Schelp
4,173,118 A 11/1979 Kawaguchi
4,216,908 A 8/1980 Sakurai et al.
4,271,664 A 6/1981 Earnest
4,288,408 A 9/1981 Guth et al.
4,297,093 A 10/1981 Morimoto et al.
4,316,580 A 2/1982 Bodai
4,356,698 A 11/1982 Chamberlain
4,407,450 A 10/1983 Chegolya et al.
4,504,211 A 3/1985 Beardmore
4,566,268 A 1/1986 Hoffeins et al.
4,575,332 A 3/1986 Oppenberg et al.
4,773,596 A 9/1988 Wright et al.
4,783,008 A 11/1988 Ikeuchi et al.
4,784,600 A 11/1988 Moreno
4,801,092 A 1/1989 Webber et al.
4,893,468 A 1/1990 Hines
4,912,931 A 4/1990 Joshi et al.
4,936,088 A 6/1990 Bell
4,955,191 A 9/1990 Okamoto et al.
4,958,488 A 9/1990 Wilkes et al.
4,989,549 A 2/1991 Korenberg
5,025,631 A 6/1991 Garbo
5,029,557 A 7/1991 Korenberg
5,042,964 A 8/1991 Gitman
5,103,630 A 4/1992 Correa
5,158,445 A 10/1992 Khinkis
5,161,379 A 11/1992 Jones et al.
5,222,357 A 6/1993 Eddy et al.
5,224,333 A 7/1993 Bretz et al.
5,247,791 A 9/1993 Pak et al.
5,259,184 A 11/1993 Borkowicz et al.
5,285,628 A 2/1994 Korenberg
5,288,021 A 2/1994 Sood et al.
5,361,578 A 11/1994 Dolan
RE35,061 E 10/1995 Correa
5,462,430 A 10/1995 Khinkis
5,467,926 A 11/1995 Idleman et al.
5,675,971 A 10/1997 Angel et al.
5,680,765 A 10/1997 Choi et al.
5,743,081 A 4/1998 Reynolds
5,778,676 A 7/1998 Joshi et al.
5,806,298 A 9/1998 Klosek et al.
5,833,141 A 11/1998 Bechtel, II et al.
5,894,720 A 4/1999 Willis et al.
5,906,094 A 5/1999 Yang et al.
5,906,806 A 5/1999 Clark
5,934,064 A 8/1999 Newby et al.
5,950,417 A 9/1999 Robertson, Jr. et al.
5,956,937 A 9/1999 Beichel
5,966,937 A 10/1999 Graves
5,970,702 A 10/1999 Beichel
6,065,281 A 5/2000 Shekleton et al.
6,076,745 A 6/2000 Primdahl
6,082,112 A 7/2000 Shekleton
6,148,602 A 11/2000 Demetri
6,162,266 A 12/2000 Wallace et al.
6,170,264 B1 1/2001 Viteri et al.
6,206,684 B1 3/2001 Mueggenburg
2001/0042367 A1 * 11/2001 Frutschi et al. ..... 60/39.02
2002/0023423 A1 * 2/2002 Viteri et al. ..... 60/39.02
2002/0134085 A1 * 9/2002 Frutschi ..... 60/772

* cited by examiner

FLUID INJECTOR AND INJECTION METHOD

CROSS-REFERENCE TO RELATED APPLICATIONS

This application is a divisional of U.S. application Ser. No. 10/242,341, filed Sep. 12, 2002 now U.S. Pat. No. 6,802,178, which is hereby incorporated herein in its entirety by reference.

BACKGROUND OF THE INVENTION

This invention relates generally to apparatuses and methods for injecting fluids and more specifically to an injector and associated method for injecting combustion fluids into a combustion chamber.

DESCRIPTION OF RELATED ART

The combustion of carbon-based compounds, or carbonaceous fuels, is widely used for generating kinetic and electrical power. In one typical electric generation system, a carbonaceous fuel such as natural gas is mixed with an oxidizer and combusted in a combustion device called a gas generator. The resulting combusted gas is discharged to, and used to rotate, a turbine, which is mechanically coupled to an electric generator. The combusted gas is then discharged to one or more additional combustion devices, called reheaters, where the combusted gas is mixed with additional fuel and/or oxidizer for subsequent combustion. The reheaters, which typically generate pressures lower than those found in the gas generator, discharge the reheated gas to one or more turbines, which are also coupled to the electric generator.

The combustion in the gas generator and reheaters results in high temperatures and pressures. In some low-emission systems, pure oxygen is used as the oxidizer to eliminate the production of nitric oxides (NOx) and sulfur oxides (SOx) that typically result from combustion with air. Combustion of carbonaceous gases with pure oxygen can generate combustion temperatures in excess of 5000° F. Such extreme conditions increase the stress on components in and around the combustion chambers, such as turbine blades and injectors. The stress increases the likelihood of failure and decreases the useful life of such components.

Injectors are used to inject the combustion components of fuel and oxidizer into the gas generator and the combusted gas, fuel, and/or oxidizer into the reheaters. Because of their position proximate to the combustion chamber, the injectors are subjected to the extreme temperatures of the combustion chamber. The injectors may also be heated by the passage of preheated combustion components therethrough. Failure of the injectors due to the resulting thermal stress caused by overheating increases operating costs, increases the likelihood of machine downtime, and presents an increased danger of worker injury and equipment damage.

One proposed injector design incorporates a mixer for combining a coolant with the fuel before the fuel is combusted. For example, U.S. Pat. No. 6,206,684 to Mueggenburg describes an injector assembly 10 that includes two mixers 30, 80. The first mixer 30 mixes an oxidizer with a fuel, and the second mixer 80 mixes coolant water with the prior mixed fuel and oxidizer. The mixture then flows through a face 121 to a combustion chamber 12 for combustion. The coolant water reduces the temperature of combustion of the fuel and, thus, the stress on system components. One danger presented by such a design is the possibility of "flash back," or the combustion flame advancing from the combustion chamber into the injector. Flash back is unlikely in an injector outlet that has a diameter smaller than the mixture's "quenching distance." Thus, flash back can be prevented by limiting the size of the injectors. Undesirably, however, a greater number of small injectors is required to maintain a specified flow rate of the combustion mixture. The increased number of injectors complicates the assembly. Small injectors are also typically less space-efficient because the small injectors require more space on the face than would a lesser number of large injectors that achieve the same flow rate. Space on the face is limited, so devoting more space to the injectors leaves less space for other uses, such as for mounting other components. The small injectors are also subject to further complications due to their size. For example, small passages and outlets in the injectors can become blocked by particulates present in the fuel, oxidizer, or coolant. Thus, the reactants must be carefully filtered before passing through the injector. Moreover, typical reheaters are not designed to accommodate liquids, so the coolant water cannot be used in them.

In another proposed oxygen-fed combustion cycle, the gas generator is eliminated and gaseous combustion components are provided for initial combustion in a gas turbine combustor. The gas turbine combustor, sometimes also called a reheater, is similar to the reheater of the conventional cycle described above in that all of the inputs are in gaseous form. Cooling is achieved by diluting the combustion components with recirculated flue gas comprising steam and carbon dioxide. The flue gas dilutes the oxygen content in the combustion device and thus the combustion temperature. One such cycle, described as "Combined Cycle Fired with Oxygen," is discussed in "New Concepts for Natural Gas Fired Power Plants which Simplify the Recovery of Carbon Dioxide," by Bolland and Saether, Energy Conversion Management, Vol. 33, No. 5–8, pp. 467–475 (1992). Advantageously, this cycle effectively reduces combustion temperatures, and the elimination of the gas generator simplifies the system. No special turbines are required for receiving hot gases from a gas generator, and the gas turbine combustor can discharge to a turbine that is designed for use with a conventional reheater. However, the gas turbine combustor is incompatible with the injectors designed for conventional gas generators, which provide inadequate flow rates and do not provide recirculated gases to the combustion chamber. Further, injectors for gas generators are typically designed to operate at the higher operating pressures found in a gas generator and are inoperable or inefficient when used in a lower pressure gas turbine combustor or reheater. Nor is the gas turbine combustor compatible with injectors designed for conventional reheaters, because the gas turbine combustor requires a lower pressure drop across the injectors than that provided in conventional reheaters.

Moreover, as the availability and price of various combustion fuels change, it is sometimes desirable to change the type of combustion fuel that is used. However, because different combustion fuels have different characteristics, such as heating values, conventional injectors must be adjusted or replaced in order to provide efficient service with the different fuels. Thus, changing the type of fuel that is combusted in a system requires servicing the injectors and thereby interrupting service, reducing output, and increasing costs.

Thus, there exists a need for an apparatus and method for injecting fluid components of combustion into a combustion chamber of a combustion device. The apparatus and method should provide for injection of a recirculated gas to limit the temperature of the injector to decrease thermal stress, likelihood of failure, and operating costs. The injectors should be compatible with combustion devices that inject gaseous coolants, including reheaters, and should provide efficient injection and mixture of combustion gases of various types and heating values.

BRIEF SUMMARY OF THE INVENTION

The present invention provides an injector and an associated method for injecting and mixing gases, comprising a carbonaceous fuel and oxygen, into a combustion chamber of a combustion device. The injector may have an annular space proximate to its perimeter, through which a recycled mixture of steam and carbon dioxide can be injected to limit the combustion temperature, thereby decreasing thermal stress on components in and around the combustion chamber. Further, the injector has different jets, which can be used to separately inject different combustion fuels. Thus, the same injector can permit different combustion fuels to be alternatingly injected, each under the proper conditions. The injector is compatible with combustion devices that inject only gaseous fluids, including a reheater. The injector can be used in a reheater that recombusts a combusted gas that is discharged from a gas generator and turbine. Alternatively, the injectors can be used in a reheater that is the initial combustion device in a power generation cycle.

According to one aspect of the present invention, there is provided an injector for injecting combustion fluids into a combustion chamber. The injector includes an injector body that defines an injector face facing the combustion chamber, a main bore, and at least one main jet extending from the injector face to the main bore. A first plurality of fuel jets extend from the injector face and are fluidly connected to a first fuel inlet, typically by means of a first fuel manifold. Similarly, a second plurality of fuel jets extend from the injector face and are fluidly connected to a second fuel inlet, typically by means of a second fuel manifold. The central axis of each of the fuel jets defines a converging angle relative to one of the main jets such that fluid flowing from the fuel manifolds into the combustion chamber through the fuel jets impinges on a stream of fluid flowing from the respective main jet. The converging angle may be between about 10° and 45° such that convergence occurs in the combustion chamber. According to other aspects of the invention, a center of each of the main jets is located at least about 4 inches from the centers of the other main jets, and each of the main jets has a diameter of at least about 1 inch.

The main bore may be fluidly connected to a source of oxidizing fluid substantially free of nitrogen and sulfur, the first fuel manifold may be fluidly connected to a first source of fuel, including hydrogen and carbon monoxide, and the second fuel manifold may be fluidly connected to a second source of fuel, including methane. Each of the first and second manifolds comprise an annular space that extends circumferentially around at least one of the main jets. In another embodiment, each of the second fuel jets may be smaller in cross sectional area than each of the first fuel jets. As such the fuel jets may be tailored to the delivery requirements necessary for the particular type of fuel to be injected via the fuel jets.

In one advantageous embodiment, the injector also includes a first sleeve that defines an interior space. The injector body is positioned in the interior space such that a first annular space is defined between the injector body and the first sleeve. In one aspect of the invention, the first annular space is fluidly connected to a source of a recycle gas comprising steam and carbon dioxide. In another aspect, the injector includes a recycle gas inlet and a second sleeve which defines a second annular space between the first and second sleeves. The first sleeve defines at least one first sleeve aperture fluidly connecting the first annular space to the second annular space, and the second sleeve defines at least one second sleeve aperture fluidly connecting the second annular space to the recycle gas inlet. In a further aspect, the injector includes a circumferential passage that extends along the perimeter of the second sleeve and fluidly connects the second annular space to the recycle gas inlet so that gas enters the recycle gas inlet and flows generally in a first direction in the second annular space and a second, generally opposite, direction in the first annular space. According to another aspect of the invention, the injector body also defines a coolant chamber that is configured to receive and circulate a coolant fluid.

The present invention also provides a method of injecting combustion fluids into a combustion chamber. At least one stream of oxidizing fluid, including oxygen and substantially free of nitrogen and sulfur, is injected into the combustion chamber. The oxidizing fluid may be injected in streams located with at least about 4 inches between their centers, and each stream may have a diameter of at least about 1 inch. A first combustion fuel and a second combustion fuel are alternatingly injected through fuel jets into the combustion chamber and impinged on the stream of oxidizing fluid. The fuel can be injected through a manifold defining an annular space that extends circumferentially around at least one of the main jets, and can be injected at a converging angle between about 10° and 45° relative to the stream of oxidizing fluid such that convergence occurs in the combustion chamber. The method also includes combusting the fuel with the oxygen. In one aspect of the present invention, a recycle gas including steam and carbon dioxide is injected into the combustion chamber through a first annular space at an inside perimeter of the combustion chamber, for example, to limit the combustion temperature to about 4000° F. In another aspect, a coolant fluid is circulated through at least one coolant chamber in an injector body.

Thus, the present invention provides an injector and method for injecting combustion fluids, for example, into a gas generator or reheater, through a first and second plurality of fuel jets. Different combustion fluids can be injected through fuel jets and combusted efficiently, thereby increasing the versatility of the injector and decreasing the necessity of replacing or modifying the injector. Additionally, the injector and method limit the temperature of the injector and decrease the thermal stress on the components, thereby decreasing the likelihood of failure and the operating costs.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
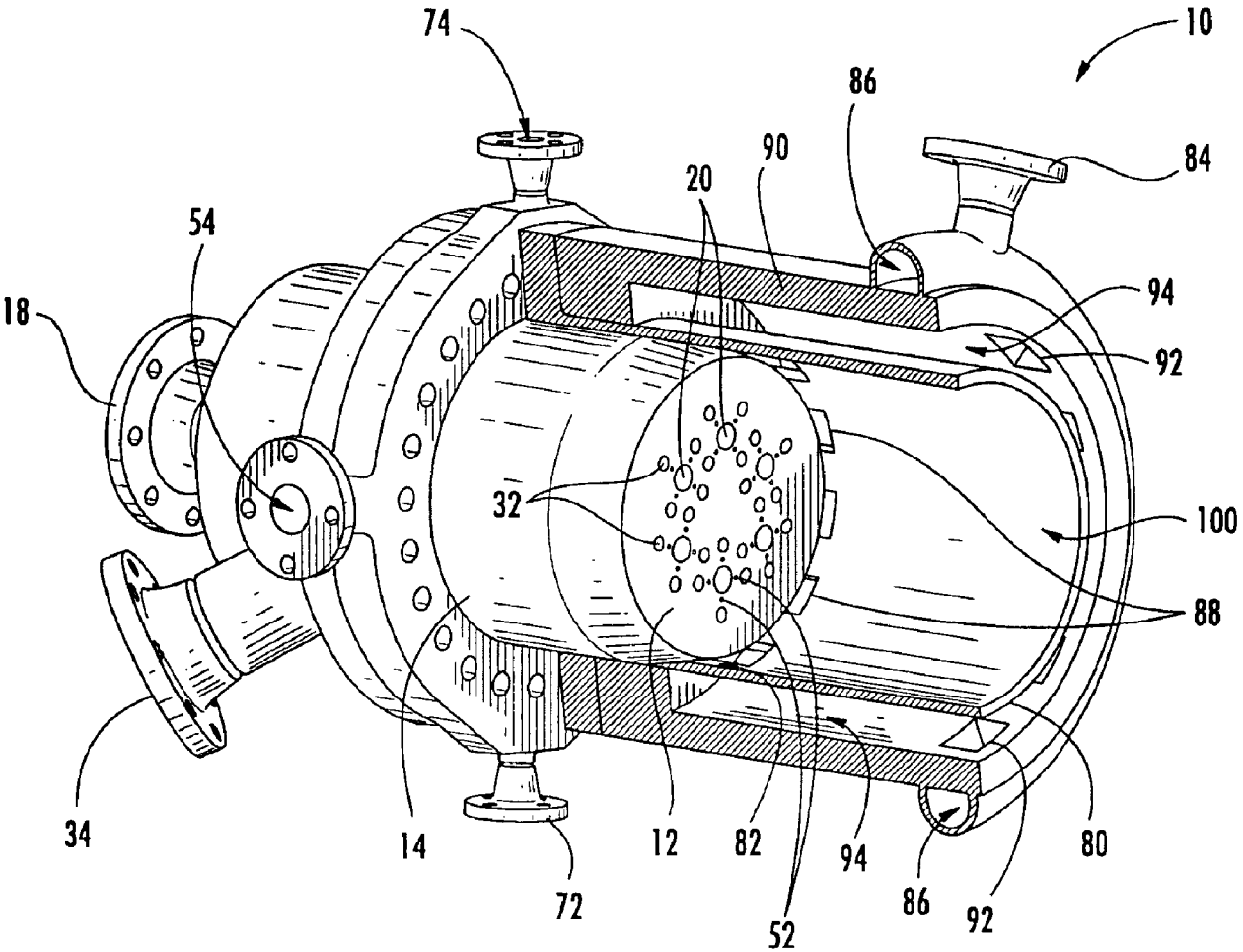
FIG. 1 is a partial cut-away isometric view of an injector according to the present invention.

There is shown in FIG. 1 an injector 10 according to the present invention, which is used to inject fluids into a combustion chamber 100. The injector 10 has an injector body 14 with an injector face 12 that is oriented towards the combustion chamber 100. The injector body 14 also includes a plurality of jets 20, 32, 52 that are fluidly connected to one or more inlets 18, 34, 54 as discussed further below. The fluids enter the injector body 14 through the inlets 18, 34, 54 and are injected into the combustion chamber through the jets 20, 32, 52. A first sleeve 80, which is generally shown as a hollow cylindrical tube, surrounds the injector body 14 and defines part of the combustion chamber 100. A first annular space 82 is defined between the outside of the injector body 14 and the inside of the first sleeve 80. A recycle gas inlet 84, which is fluidly connected to the first annular space 82, supplies a recycle gas through the annular space 82 to the inside perimeter of the first annular space 82 and the combustion chamber 100.

The combustion that results in the combustion chamber 100 is a combustion of a fuel and oxygen. The fuel can be, for example, a carbonaceous gas such as methane, ethane, propane, or a mixture of hydrocarbons and may be derived from crude oil or a biomass fuel. Two advantageous carbonaceous fuels are methane and a synthesis gas, or syngas, which includes hydrogen and carbon monoxide. The carbonaceous fuel can be in liquid, gaseous, or combined phases. The oxygen is supplied in an oxidizing fluid. In one advantageous embodiment of the invention, the carbonaceous fuel and the oxygen are supplied in gaseous form and substantially free of nitrogen and sulfur. In the context of this patent, the phrase "substantially free of nitrogen and sulfur" indicates a combined content of less than 0.1 percent nitrogen and sulfur by weight and preferably less than 0.01 percent. Oxygen can be separated from atmospheric air according to methods known in the art and may include trace gases, such as argon.

The combustion of fuel and oxygen in the combustion chamber 100 generates a combusted gas and causes an increase in temperature and gas volume and a corresponding increase in pressure. The combusted gas is discharged to a power take-off device, such as a turbine, and useful energy is generated for use or storage. For example, the turbine can be coupled to an electric generator, which is rotated to generate electricity.

Figure 2:
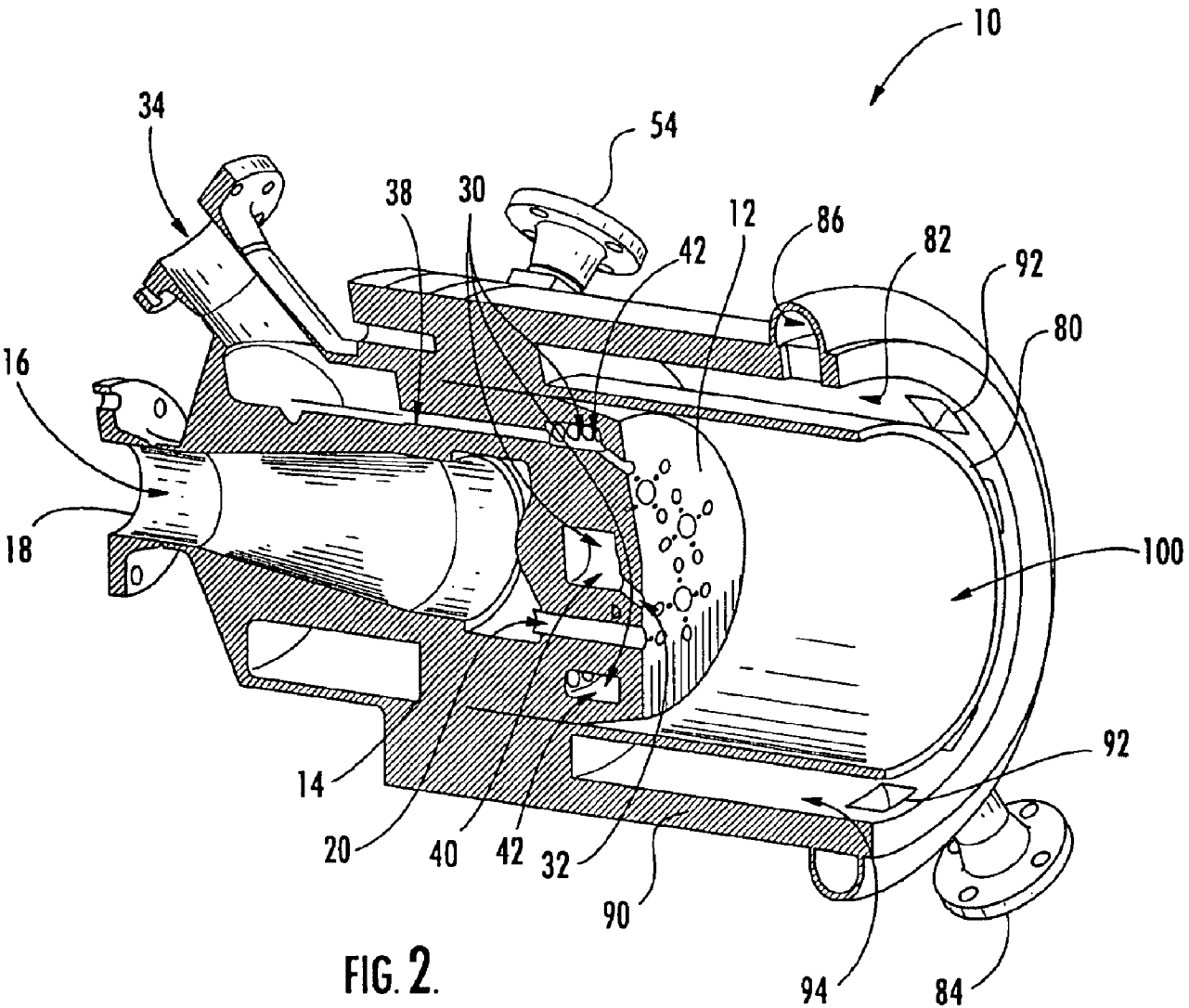
FIG. 2 is another partial cut-away isometric view of the injector of FIG. 1.

As shown in FIG. 2, the oxidizing fluid is supplied through the main inlet 18 to a main bore 16 of the injector body 14. The oxidizing fluid flows from the main bore 16 through the injector face 12 and into the combustion chamber 100 via a plurality of main jets 20. Six main jets 20 are shown in the illustrated embodiment, but any number of jets 20 may be provided. The diameter of the main jets 20 is chosen so that predetermined flow rates of oxidizing fluid through the main jets 20 can be achieved by supplying the oxidizing fluid to the main inlet 18 at predetermined pressures higher than the pressure in the combustion chamber 100. In one advantageous embodiment, each of the main jets 20 has a diameter at the injector face 12 of at least about 1 inch, and a center of each of the main jets 20 is at least about 4 inches from the centers of the other main jets 20. The oxidizing fluid flows into the combustion chamber 100 as streams emitted from the main jets 20, which, in the illustrated embodiment, are generally oriented parallel to a central axis that extends lengthwise through the main bore 16 of the injector body 14.

Figure 4:
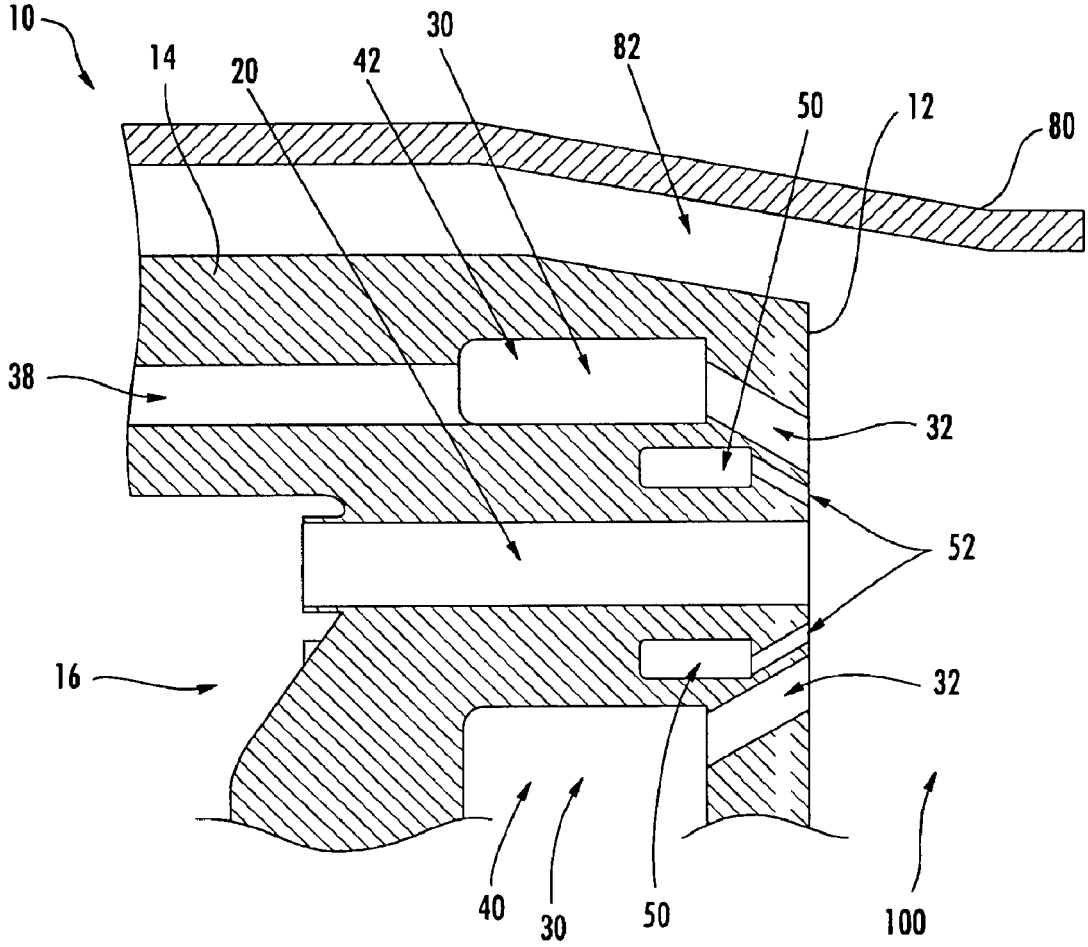
FIG. 4 is a partial cross-sectional view of the injector of FIG. 3 as seen from line 4—4.

A first fuel enters the first fuel inlet 34 and flows through a first fuel downcomer 38 to a first fuel manifold 30. The first fuel manifold 30 is an interior space defined by the injector body 14 that fluidly connects the downcomer 38, and hence the first fuel inlet 34, to the first fuel jets 32. As shown in FIGS. 2 and 4, the first fuel manifold 30 of the illustrated embodiment comprises both an annular chamber 42 that extends circumferentially around the main jets 18 and a central chamber 40 located central to the main jets 18. The central chamber 40 and the annular chamber 42 are fluidly connected by tunnels (not shown) that are generally perpendicular to the main jets 18. It is appreciated that there are numerous alternative configurations of the first fuel manifold 30, the downcomer 38, and the first fuel inlet 34 for fluidly connecting the first fuel source to the first fuel jets 34.

The first fuel is discharged from the first fuel jets 32 into the combustion chamber 100. In the illustrated embodiment, 24 first fuel jets are provided, with 4 located at spaced intervals around each of the main jets 20, though any number of first fuel jets 32 can be provided. Each of the first fuel jets 32 is configured such that a central axis of each first fuel jet 32 converges with a central axis of the respective main jet 20 in the combustion chamber 100 so that fuel discharged from the first fuel jets 32 impinges on the stream of oxidizing fluid flowing from the respective main jet 20.

Similar to the first fuel, a second fuel enters the second fuel inlet 54 and flows through a second fuel downcomer (not shown) to a second fuel manifold 50. The second fuel manifold 50 is an interior space defined by the injector body 14 that fluidly connects the second fuel downcomer, and hence the second fuel inlet 54, to the second fuel jets 52. As shown in FIG. 4, the second fuel manifold 50 of the illustrated embodiment comprises 6 annular chambers, each extending circumferentially around one of the main jets 20. The annular chambers are fluidly connected to one another by tunnels (not shown) that extend in a direction generally perpendicular to the main jets 20. In the illustrated embodiment, 24 second fuel jets are provided, with 4 located at spaced intervals around each of the main jets 20. Each of the second fuel jets 52 is also configured such that a central axis of each second fuel jet 52 converges with the central axis of the respective main jet 20 in the combustion chamber 100 so that fuel discharged from each of the second fuel jets 52 into the combustion chamber 100 impinges on the stream of oxidizing fluid flowing from the respective main jet 20.

The converging angle between each of the fuel jets 32, 52 and the respective main jet 20 affects the extent to which the fuel is mixed with the oxidizing fluid as well as the location in the combustion chamber 100 at which the fuel and oxidizing fluid are sufficiently mixed for combustion to occur. The distance between each of the fuel jets 32, 52 and the respective main jet 20 also affects the mixing of the fuel and oxidizing fluid. If the mixing and the combustion of the fuel and oxidizing fluid occur close to the injector face 12, the injector face 12 and the injector 10 may be more subject to the heat generated by the combustion and require additional cooling. In one advantageous embodiment of the present invention, each of the first and second fuel jets 32, 52 defines a converging angle relative to one of the main jets 20 of between about 10° and 45°. In another embodiment, the fuel jets are configured such that fuel flowing from the fuel jets 32, 52 impinges on the stream of oxidizing fluid flowing from the respective main jet 20 in a region located within about 2 inches of the injector face 12. Thus, the fuel that is discharged through the jets 32, 52 mixes with the oxidizing fluid and facilitates a uniform combustion of the fuel. However, the fuel is not mixed and combusted so close to the jets 20, 32, 52 that the combustion occurs in the injector 10.

Figure 3:
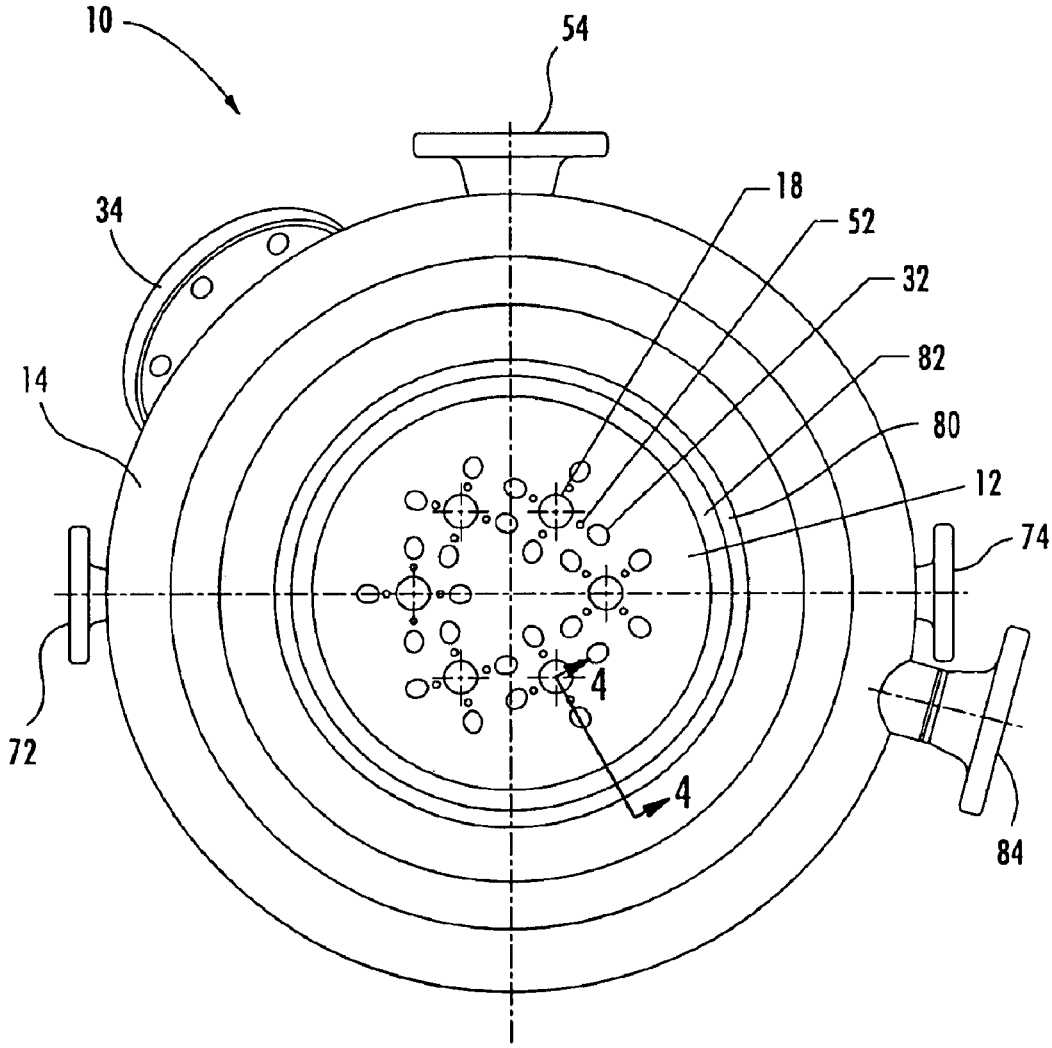
FIG. 3 is an elevation view of the injector of FIG. 1.

The arrangement of the first and second fuel jets 32, 52 is shown in FIG. 3. It is appreciated that any number of first and second fuel jets 32, 52 can be provided, including a single first and second jet 32, 52 for each main jet 20. Preferably, the first and second jets 32, 52 are arranged symmetrically about the main jets 20, but asymmetric arrangements are also possible. Also, while jets 32, 52 in the illustrations have a round cross section, other shapes are also possible. For example, one or both of the first and second fuel jets 32, 52 can be a single jet that defines a slot extending circumferentially around all or part of the main jets 20. Further, FIG. 3 illustrates the difference in cross-sectional size between the first fuel jets 32 and the second fuel jets 52. Although any size of jets 32, 52 can be used, the size of the jets 32, 52 preferably is chosen in consideration of the heating value of the fuels, the operating pressure, and the number of jets 32, 52. For example, the diameters of the jets 32, 52 can be calculated according to the required mass flow rate of fuel for the desired combustion and the necessary momentum of the fuel into the combustion chamber 100 for proper mixing with the oxidizing fluid. The required mass flow rate of different fuels may vary according to the heating values of the fuels, though it may be desirable to inject the different fuels with similar momentum to ensure proper mixing of each fuel with the oxidizing fluid. Thus, the differently sized jets 32, 52 allow the use of different fuels while still maintaining the same rate of heat generation and the same momentums of the fuels. For example, in the embodiment shown in FIG. 3, the first fuel jets 32 are approximately three times the diameter of the second fuel jets 52. Thus, if the first fuel jets 32 are used for a first fuel that has a heating value of approximately one-third of the heating value of the second fuel, the amount of heat generated by the two fuels will be similar if the two fuels have equivalent densities and are injected at similar momentums.

The relative sizes of the injector 10 and jets 20, 32, 52 are also shown in FIG. 3. In one embodiment, the diameter of the injector 10 is about 12.5 inches wide, and the diameters of the fuel jets 32, 52 are at least about 0.1 inch. The main jets 20 are about one inch in diameter at the injector face 12, and a center of each of the main jets 20 is at least about 4 inches from the centers of the other main jets 20.

In one advantageous embodiment, the second fuel jets 52 are used to inject natural gas, which is approximately 90 percent methane. The first fuel jets 32 are used to inject a synthesis comprising carbon monoxide, hydrogen, and carbon dioxide. The synthesis gas can be generated by using steam and oxygen for the gasification of petcoke, which is about 90 percent solid carbon by weight, moisture, and ash. The first fuel and the second fuel can be injected simultaneously, but according to one advantageous embodiment of the present invention, only one of the first and second gases is injected at a time. Thus, fuel gas that is used for combustion can be changed without changing the injector 10 and can be chosen according to other criteria such as availability, price, and efficiency. Additionally, it is understood that additional jets can be provided to further improve the versatility of the injector 10. For example, the injector 10 can include a third set of fuel jets (not shown) with a corresponding fuel manifold and inlet, thus allowing a third fuel source to be independently supplied to the combustion chamber 100. The configuration of each of the first and second plurality of fuel jets 32, 52, and any additional fuel jets, can be tailored to inject a particular type of gas under particular conditions. For example, the number and size of the first fuel jets 32 and the spacing and angle between the first jets 32 and the main jets 20 can be tailored specifically for the injection of a particular fuel through the first jets 32, for example, a synthesis gas comprising hydrogen and carbon monoxide. Similarly, the second fuel jets 52, and any additional sets of fuel jets, can be configured for other fuels such as methane or natural gas.

As shown in FIGS. 1 and 2, a second sleeve 90 circumferentially surrounds the first sleeve 80, defining a second annular space 94 between the two sleeves 80, 90. The second annular space 94 is fluidly connected to a circumferential passage 86, which extends around the second sleeve 90, and to a diluent gas inlet 84. The diluent gas inlet 84 is fluidly connected to a source of diluent gas (not shown). Thus, the diluent gas enters the diluent gas inlet 84 and flows through the circumferential passage 86 and into the second annular space 94 through the second sleeve apertures 92. The diluent gas flows through the second annular space 94 in a direction that is generally opposite to the direction of the oxidizing fluid and the fuel in the jets 20, 32, 52. From the second annular space 94, the diluent gas flows through a plurality of first sleeve apertures 88 that fluidly connect the second annular space 94 and the first annular space 82. Once in the first annular space 82, the diluent gas reverses its direction of flow and flows toward the combustion chamber 100, where it is then mixed with and becomes part of the combustion gas in the combustion chamber 100. The diluent gas dilutes the combustion gas and moderates the temperature of the combustion. Although liquid diluents can also be used, a gaseous diluent is preferred. Various diluent gases can be used including, in one advantageous embodiment, a recycle gas from a turbine in which the combustion gas from the combustion chamber 100 is expanded. The recycle gas comprises steam and carbon dioxide. The degree of cooling that is provided by the recycle gas depends on the combustion temperature, the flow rate of the gases into the combustion chamber 100, the temperature of the recycle gas, and the composition of the recycle gas. Preferably, the temperature in the combustion chamber 100 is reduced to at least about 4000° F., and most preferably to about 2000° F.

The injector 10 can also be cooled by a coolant fluid such as water that flows through a coolant chamber (not shown). The coolant chamber is an interior gap defined by the injector body 10, which is fluidly connected to a coolant inlet 72 and a coolant outlet 74. Coolant fluid is pumped into the coolant inlet 72 and discharged from the coolant outlet 74. It will be appreciated that various configurations of coolant chambers can be used as are known in the art.

In one advantageous embodiment of the present invention, the injector 10 is used to inject gases into a combustion chamber 100 that is compatible only with gases. For example, the injector 10 can be used to inject a carbonaceous gas, gaseous oxygen, and a mixture of steam and carbon dioxide into a reheater that is used to combust gases in an electricity generation plant. The reheater can recombust an exhaust gas that is discharged from a gas generator and turbine, as discussed in U.S. patent application Ser. No. 10/242,715, titled "LOW-EMISSION, STAGED-COMBUSTION POWER GENERATION," filed concurrently herewith and the entirety of which is incorporated herein by reference. Alternatively, the reheater can be the initial combustion device in a power generation cycle as shown, for example, in FIG. 5.

Figure 5:
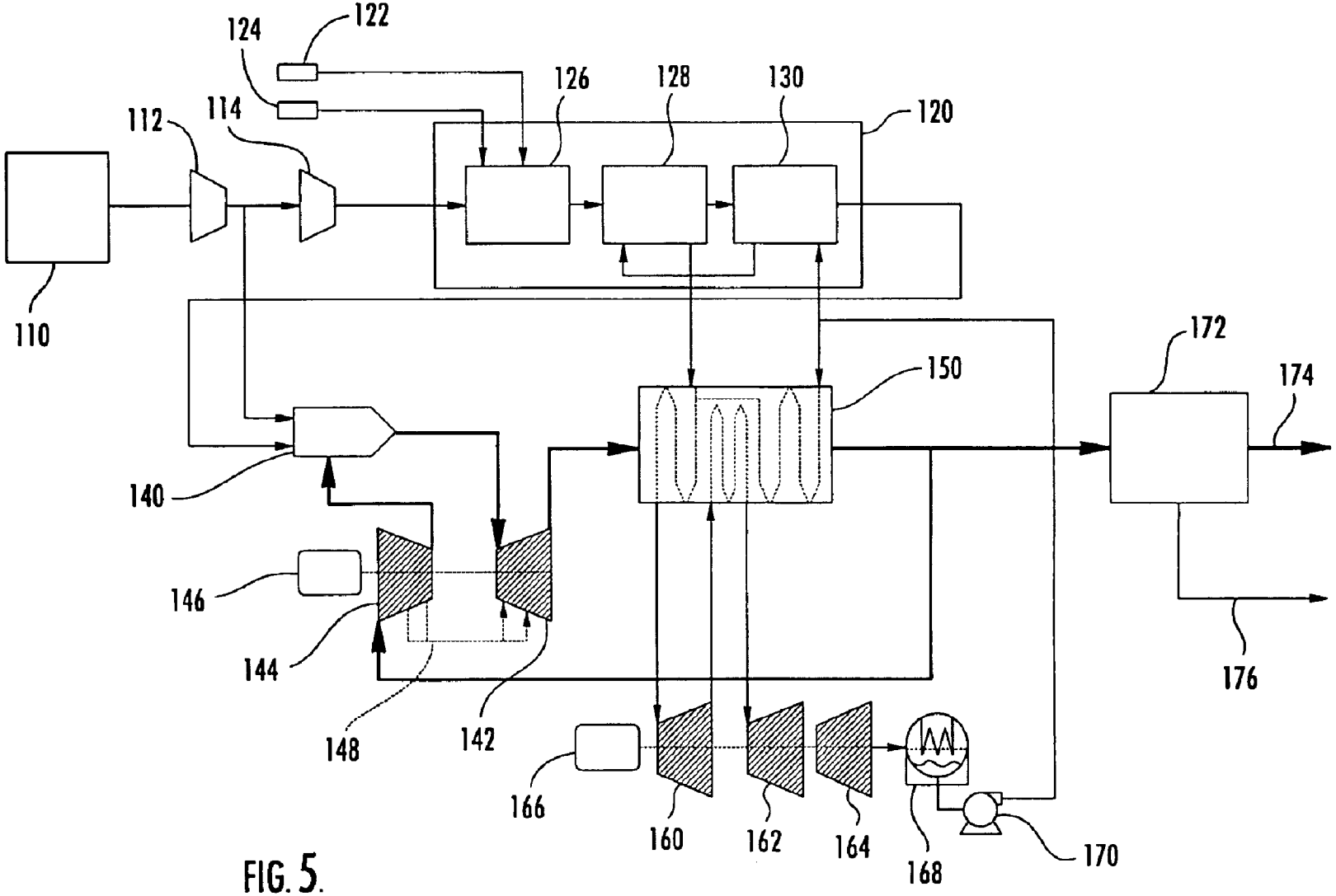
FIG. 5 is a schematic of a power generation cycle that is compatible with the injector of the present invention.

The power generation cycle shown in FIG. 5 includes a reheater 140 that receives oxygen and a carbonaceous gas, for example, a synthesis gas, for combustion. The oxygen is generated in an air separation unit 110, which removes at least most of the nitrogen from the air and discharges the oxygen substantially free of nitrogen and sulfur. The nitrogen can be removed using a cryogenic process, as will be understood by one of ordinary skill in the art. In that case, the cryogenic nitrogen that is derived from the process can be sold or used in subsequent cooling processes in the power generation cycle. In other embodiments, the oxidizing fluid can be derived from sources other than the air separation unit 110, for example, from a storage tank, delivery pipeline, or other oxygen generation apparatuses that are known in the art.

In the illustrated embodiment of FIG. 5, the synthesis gas, or syngas, is generated in a syngas generator 120. The syngas generator 120 is shown for illustrative purposes only, and it is understood that syngas can be obtained by other processes known in the art. Further, combustion gases other than syngas can be used. For example, the combustion gas can comprise methane, ethane, propane, or a mixture of hydrocarbons and may be derived from crude oil or a biomass fuel.

The oxidizing fluid is compressed by compressors 112, 114 and delivered to the reheater 140 and the syngas generator 120. The syngas generator 120 includes a gasifier 126 that also receives water and petroleum coke, or petcoke, from water and petcoke sources 122, 124. The petcoke is gasified in the gasifier 126 to form an exhaust gas that includes the syngas, as known in the art. The syngas comprises hydrogen, carbon monoxide, and carbon dioxide, and in this embodiment specifically comprises about 50 percent carbon monoxide, 34.2 percent hydrogen, and 15.8 percent carbon dioxide. The syngas is passed through a high temperature heat recoverer 128 and a low temperature heat recoverer 130, both of which are thermally coupled to a heat recovery steam generator 150, described below.

The syngas is then discharged to the reheater 140. The syngas enters the reheater 140 through the injectors 10, as do the oxygen and a diluent. The diluent is a recycle gas that includes steam and carbon dioxide. The diluent dilutes the oxygen in the reheater, limiting the temperature in the reheater 140. The product gas is combusted in the combustion chamber 100 of the reheater 140 to form a combusted gas or combustion product, which is discharged to a primary turbine 142. The combustion product is expanded in the primary turbine 142 and energy is generated by rotating an electric generator 146 that is mechanically or hydraulically coupled to the primary turbine 142. The combustion product from the primary turbine 142 is discharged to the heat recovery steam generator 150 where the combustion product is cooled. The heat recovery steam generator 150 acts as a heat exchanger by using thermal energy of the combustion product discharged from the primary turbine 142 to heat an intermediate exhaust gas from the high temperature heat recoverer 128. The intermediate exhaust gas is then discharged to a first turbine 160. The intermediate exhaust gas is discharged from the first turbine 160 to the heat recovery steam generator 150 where it is reheated and discharged to a second turbine 162 and then a third turbine 164. The intermediate exhaust gas is expanded in the turbines 160, 162, 164, and the temperature and pressure of the intermediate exhaust gas are decreased. The operating pressures of the turbines 160, 162, 164 decrease consecutively so that the second turbine 162 operates at a pressure that is lower than that of the first turbine 160 and higher than that of the third turbine 164. The turbines 160, 162, 164 are coupled to an electric generator 166, which is rotated by the turbines 160, 162, 164 and generates electricity. Subsequently, the intermediate exhaust gas is discharged to a condenser 168 and a pump 170, which returns the condensed exhaust to the syngas generator 120.

The combustion product is cooled in the heat recovery steam generator 150. A first portion of the combustion product is recycled from the heat recovery steam generator 150 to a compressor 144, which compresses the combustion product and discharges the combustion product as the diluent to the reheater 140. Bleed lines 148 connect the compressor 144 to the primary turbine 142. The compressor 144 can be driven by a shaft that also couples the primary turbine 142 to the electric generator 146. Although not shown, a single drive shaft may be driven by all of the turbines 142, 160, 162, 164, and the same shaft may also drive the compressor 144. In the embodiment of FIG. 5, the diluent comprises approximately 67 percent steam and 33 percent carbon dioxide, though the actual proportions can vary.

A second portion of the combustion product is discharged to a high pressure compressor 172 where it is compressed to liquefy the carbon dioxide in the combustion product. The carbon dioxide is then discharged via a carbon dioxide outlet 174 and water is discharged through a water outlet 176. The carbon dioxide and water may be recycled for use in other parts of the generation cycle or discharged.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of injecting and combusting combustion fluids in a combustion chamber, comprising:

injecting at least one stream of oxidizing fluid into the combustion chamber, the oxidizing fluid comprising oxygen and substantially free of nitrogen and sulfur, alternatingly injecting a first combustion fuel through a first plurality of fuel jets into the combustion chamber and a second combustion fuel through a second plurality of fuel jets into the combustion chamber, such that the first and second combustion fuels impinge on the stream of oxidizing fluid in the combustion chamber; and combusting the combustion fuel with the oxidizing fluid.

2. A method according to claim 1 wherein injecting a first combustion fuel comprises injecting the first combustion fuel from the first fuel jets located at a first plurality of locations about each stream of oxidizing fluid such that the first combustion fuel from the first plurality of locations impinges on the respective stream of oxidizing fluid and wherein injecting a second combustion fuel comprises injecting the second combustion fuel from the second fuel jets located at a second plurality of locations about each stream of oxidizing fluid such that the second combustion fuel from the second plurality of locations impinges on the respective stream of oxidizing fluid.

3. A method according to claim 1 further comprising injecting a recycle gas comprising steam and carbon dioxide into the combustion chamber through a first annular space at an inside perimeter of the combustion chamber.

4. A method according to claim 1 wherein injecting a first combustion fuel comprises injecting a synthesis gas of hydrogen and carbon monoxide and wherein injecting a second combustion fuel comprises injecting methane.

5. A method according to claim 1 wherein injecting a first combustion fuel and injecting a second combustion fuel comprise injecting the first and second combustion fuels at dissimilar mass rates.

6. A method according to claim 1 wherein injecting the first combustion fuel comprises injecting the first combustion fuel through a manifold comprising an annular space that extends circumferentially around the at least one stream of oxidizing fluid.

7. A method according to claim 1 wherein injecting a first combustion fuel comprises injecting the first combustion fuel into the combustion chamber at a converging angle of between about 10° and 45° relative to the central axis of one of the at least one stream of oxidizing fluid such that such that the first combustion fuel impinges on the respective stream of oxidizing fluid in the combustion chamber and wherein injecting a second combustion fuel comprises injecting the second combustion fuel into the combustion chamber at a converging angle of between about 10° and 45° relative to the central axis of one of the at least one stream of oxidizing fluid, the second combustion fuel impinging on the respective stream of oxidizing fluid in the combustion chamber.

8. A method according to claim 1 further comprising circulating a coolant fluid through at least one coolant chamber in an injector body.

9. A method according to claim 1 wherein injecting at least one stream of oxidizing fluid comprises injecting a plurality of streams of oxidizing fluid, each stream having a center located at least about 4 inches from the centers of the other streams.

10. A method according to claim 1 wherein injecting at least one stream of oxidizing fluid comprises injecting a stream of oxidizing fluid with a diameter of at least about 1 inch.

11. A method according to claim 1 further comprising injecting a recycle gas comprising steam and carbon dioxide into the combustion chamber to limit the combustion temperature to about 4000° F.

* * * * *